US007141157B2

(12) United States Patent
Rosenbaum et al.

(10) Patent No.: US 7,141,157 B2
(45) **Date of Patent: *Nov. 28, 2006**

(54) BLENDING OF LOW VISCOSITY FISCHER-TROPSCH BASE OILS AND FISCHER-TROPSCH DERIVED BOTTOMS OR BRIGHT STOCK

(75) Inventors: John Rosenbaum, Richmond, CA (US); David Kramer, San Anselmo, CA (US); Joseph Pudlak, Vallejo, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 686 days.

This patent is subject to a terminal disclaimer.

(21) Appl. No.: 10/387,211

(22) Filed: Mar. 11, 2003

(65) Prior Publication Data

US 2004/0178118 A1 Sep. 16, 2004

(51) Int. Cl.
*C10M 101/02* (2006.01)
*C10M 105/02* (2006.01)

(52) U.S. Cl. ..... 208/18; 208/19; 208/950; 508/110; 585/1; 585/502

(58) Field of Classification Search ..... 208/18, 208/19, 950
See application file for complete search history.

(56) References Cited

U.S. PATENT DOCUMENTS

| | | | | |
|---|---|---|---|---|
| 2,668,790 | A | 2/1954 | Good et al. | |
| 2,668,866 | A | 2/1954 | Good et al. | |
| 4,812,246 | A | 3/1989 | Yabe | |
| 4,906,350 | A | 3/1990 | Lucien et al. | |
| 5,135,638 | A | 8/1992 | Miller | |
| 6,008,164 | A | 12/1999 | Aldrich et al. | |
| 6,059,955 | A | 5/2000 | Cody et al. | |
| 6,080,301 | A | 6/2000 | Berlowitz et al. | |
| 6,090,989 | A | 7/2000 | Trewella et al. | |
| 6,096,940 | A | 8/2000 | Wittenbrink et al. | |
| 6,165,949 | A | 12/2000 | Berlowitz et al. | |
| 6,332,974 | B1 | 12/2001 | Wittenbrink et al. | |
| 6,627,779 | B1 * | 9/2003 | O'Rear | 585/302 |
| 6,686,511 | B1 * | 2/2004 | Miller et al. | 585/519 |
| 6,703,353 | B1 * | 3/2004 | Lok et al. | 508/110 |
| 6,841,711 | B1 * | 1/2005 | Krug et al. | 585/326 |

FOREIGN PATENT DOCUMENTS

| | | |
|---|---|---|
| EP | 0 515 256 B1 | 3/1997 |
| EP | 0 776 959 A3 | 6/1997 |
| WO | WO 99/41335 | 8/1999 |
| WO | WO 00/08115 | 2/2000 |
| WO | WO 00/14179 | 3/2000 |
| WO | WO 00/14187 | 3/2000 |
| WO | WO 02/070627 A2 | 9/2002 |

OTHER PUBLICATIONS

"Platforming of Paraffin Wax", Journal of the Institute of Petroleum, 1956, vol. 43, pp. 205-216 by Schenk et al., University of Chemical Engineering, Delft.
"Hydro-Isomerization of Paraffin Wax", Journal of the Institute of Petroleum, vol. 43, No. 407, pp. 297-306, Nov. 1957 by Breimer et al., University of Chemical Engineering, Delft, Holland.

* cited by examiner

*Primary Examiner*—Ellen M. McAvoy
(74) *Attorney, Agent, or Firm*—Steven H. Roth

(57) ABSTRACT

A process for preparing Fischer-Tropsch derived lubricating base oils by blending a Fischer-Tropsch distillate fraction having a viscosity of 2 or greater but less than 3 cSt at 100 degrees C. with a Fischer-Tropsch derived bottoms fraction; lubricating base oil compositions having a viscosity between about 3 and about 10 cSt at 100 degrees C. and a TGA Noack volatility of less than about 45 weight percent; and finished lubricants using the aforesaid lubricating base oils.

37 Claims, No Drawings

BLENDING OF LOW VISCOSITY FISCHER-TROPSCH BASE OILS AND FISCHER-TROPSCH DERIVED BOTTOMS OR BRIGHT STOCK

CROSS REFERENCE TO RELATED APPLICATIONS

This application is related to U.S. patent application Ser. No. 10/235,150 filed Sep. 4, 2002, titled "Blending of Low Viscosity Fischer-Tropsch Base Oils to Produce High Quality Lubricating Base Oils" and U.S. patent application Ser. No. 10/301,391 filed Nov. 20, 2002, titled "Blending of Low Viscosity Fischer-Tropsch Base Oils With Conventional Base Oils to Produce High Quality Lubricating Base Oils".

FIELD OF THE INVENTION

The invention relates to the blending of a low viscosity Fischer-Tropsch derived base oil fraction with a higher viscosity Fischer-Tropsch derived bottoms fraction to produce a high quality lubricating base oil that is useful for preparing commercial finished lubricants such as in crankcase engine oils.

BACKGROUND OF THE INVENTION

Finished lubricants and greases used for various applications, including automobiles, diesel engines, natural gas engines, axles, transmissions, and industrial applications consist of two general components, a lubricating base oil and additives. Lubricating base oil is the major constituent in these finished lubricants and contributes significantly to the properties of the finished lubricant. In general, a few lubricating base oils are used to manufacture a wide variety of finished lubricants by varying the mixtures of individual lubricating base oils and individual additives.

Numerous governing organizations, including original equipment manufacturers (OEM's), the American Petroleum Institute (API), Association des Consructeurs d' Automobiles (ACEA), the American Society of Testing and Materials (ASTM), the Society of Automotive Engineers (SAE), and National Lubricating Grease Institute (NLGI) among others, define the specifications for lubricating base oils and finished lubricants. Increasingly, the specifications for finished lubricants are calling for products with excellent low temperature properties, high oxidation stability, and low volatility. Currently only a small fraction of the base oils manufactured today are able to meet the demanding specifications of premium lubricant products.

Syncrudes prepared from the Fischer-Tropsch process comprise a mixture of various solid, liquid, and gaseous hydrocarbons. Those Fischer-Tropsch products which boil within the range of lubricating base oil contain a high proportion of wax which makes them ideal candidates for processing into lubricating base oil stocks. Accordingly, the hydrocarbon products recovered from the Fischer-Tropsch process have been proposed as feedstocks for preparing high quality lubricating base oils. When the Fischer-Tropsch waxes are converted into Fischer-Tropsch base oils by various processes, such as hydroprocessing and distillation, the base oils produced usually fall into different narrow-cut viscosity ranges. Typically, the kinematic viscosity of the various cuts will range between 2.1 cSt and 12 cSt at 100 degrees C. Since the kinematic viscosity of lubricating base oils typically will fall within the range of from 3 to 32 cSt at 100 degrees C., the base oils that fall outside of this viscosity range have limited use and, consequently, have less market value for engine oils.

The Fischer-Tropsch process typically produces a syncrude mixture containing a wide range of products having varying molecular weights but with a relatively high proportion of the products characterized by a low molecular weight and viscosity. Used by itself, this low viscosity product is not suitable for many lubricant applications, especially high volume applications, such as for engine oil. Currently, those Fischer-Tropsch derived base oils having kinematic viscosities below 3 cSt at 100 degrees C. have a limited market and are usually cracked into lower molecular weight material, such as diesel and naphtha. However, diesel and naphtha have a lower market value than lubricating base oil. It would be desirable to be able to upgrade these low viscosity base oils into products suitable for use as a lubricating base oil.

Conventional base oils prepared from petroleum derived feedstocks having a kinematic viscosity below 3 cSt at 100 degrees C. have a low viscosity index (VI) and high volatility. Consequently, low viscosity conventional base oils are unsuitable for blending with higher viscosity conventional base oils because the blend will fail to meet the VI and volatility specifications for many finished lubricants. Surprisingly, it has been found that Fischer-Tropsch derived base oils having a kinematic viscosity above 2 and below 3 cSt at 100 degrees C. display unusually high VI's, resulting in excellent low temperature properties and volatilities similar to those seen in conventional Group I and Group II light neutral base oils which have a kinematic viscosity generally falling in the range of between 3.8 and 4.7 cSt at 100 degrees C. Even more surprising was that when the low viscosity Fischer-Tropsch derived base oils were blended with certain Fischer-Tropsch derived bottom fractions or bright stock, a VI premium was observed, i.e., the VI of the blend was significantly higher than would have been expected from a mere averaging of the VI's for the two fractions. Consequently, it is has been discovered that the low viscosity Fischer-Tropsch base oils fractions may be advantageously employed as blending stock to prepare premium lubricants.

While Fischer-Tropsch derived lubricating base oil blends have been described in the prior art, the method used to prepare them and the properties of the prior art blends differ from the present invention. See, for example, U.S. Pat. Nos. 6,332,974; 6,096,940; 4,812,246; and 4,906,350. It has not been previously taught that Fischer-Tropsch fractions having a viscosity of less than 3 cSt at 100 degrees C. could be used to prepare lubricating base oils suitable for blending finished lubricants meeting the specifications for SAE Grade 10W, and 15W multigrade engine oils; monograde engine oils, automatic transmission fluids; and ISO Viscosity Grade 22, 32, and 46 industrial oils. With the present invention, this becomes possible.

When referring to conventional lubricating base oils this disclosure is referring to conventional petroleum derived lubricating base oils produced using petroleum refining processes well documented in the literature and known to those skilled in the art.

As used in this disclosure the word "comprises" or "comprising" is intended as an open-ended transition meaning the inclusion of the named elements, but not necessarily excluding other unnamed elements. The phrase "consists essentially of" or "consisting essentially of" is intended to mean the exclusion of other elements of any essential significance to the composition. The phrase "consisting of" or "consists of" are intended as a transition meaning the exclusion of all but the recited elements with the exception of only minor traces of impurities.

SUMMARY OF THE INVENTION

The present invention is directed to a process for producing a Fischer-Tropsch derived lubricating base oil blend which comprises blending a Fischer-Tropsch distillate fraction with a Fischer-Tropsch derived bottoms fraction in the proper proportion to produce a Fischer-Tropsch derived lubricating base oil characterized as having a kinematic viscosity of between about 3 and about 10 cSt at 100 degrees C. and a TGA Noack volatility of less than about 45 weight percent wherein said distillate fraction is characterized by a kinematic viscosity of about 2 cSt or greater but less than 3 cSt at 100 degrees C.

The Fischer-Tropsch derived bottoms fraction will generally have a kinematic viscosity at 100 degrees C. of not less than about 7 cSt. The Fischer-Tropsch derived bottoms fraction may constitute that residual fraction remaining at the bottom of the vacuum column following the fractionation of the waxy material recovered directly from Fischer-Tropsch syncrude, or it may be prepared from the condensate fraction by the oligomerization of the olefins present. Except for bright stock, most Fischer-Tropsch bottoms fractions will have a kinematic viscosity within the range of from about 9 cSt to about 20 cSt at 100 degrees C., preferably, between about 10 cSt and 16 cSt. However, in the case of Fischer-Tropsch derived bright stock the kinematic viscosity may be considerably higher. The invention makes it possible to upgrade the low viscosity Fischer-Tropsch derived base oils into more valuable premium lubricants which otherwise would be cracked or blended into lower value transportation fuels.

Bright stock constitutes a bottoms fraction which has been highly refined and dewaxed. Bright stock is a high viscosity base oil. Conventional petroleum derived bright stock is named for the SUS viscosity at 210 degrees F., having viscosities above 180 cSt at 40 degrees C., preferably above 250 cSt at 40 degrees C., and more preferably ranging from 500 to 1100 cSt at 40 degrees C. Fischer-Tropsch derived bright stock has a kinematic viscosity between about 15 cSt and about 40 cSt at 100 degrees C. Bright stock used to carry out the invention may be produced from Fischer-Tropsch derived residual stocks recovered from the bottom of the vacuum column following the fractionation of the waxy product separated from the syncrude from the Fischer-Tropsch plant. However, Fischer-Tropsch derived bright stock may also be prepared from the oligomerization of the olefins present in the Fischer-Tropsch condensate recovered from the Fischer-Tropsch reactor. Blending Fischer-Tropsch derived bright stock with the Fischer-Tropsch derived distillate fraction produces a lubricating base oil having especially low volatility, good cold flow properties, and improved oxidation stability as compared to many conventional base oils.

Lubricating base oils falling within the scope of the invention are blends of at least two different fractions. One fraction is a light distillate fraction and the other fraction is a bottoms fraction. Accordingly, lubricating base oils of the invention are distinguished from those homogeneous lubricating base oils prepared from a single distillate fraction or from only a bottoms fraction. Consequently, the Fischer-Tropsch lubricating base oil blends prepared using the process of the present invention are unique, and will display certain properties which may be used to distinguish the blends from both conventional and from other Fischer-Tropsch derived lubricating base oils disclosed in the prior art. For example, lubricating base oil blends prepared according to the invention will have a TGA Noack volatility of greater than about 12 and more generally will have a TGA Noack volatility in excess of about 20. However, if the blends are intended for use as crankcase lubricating oils they will preferably have a Noack volatility of less than about 30 weight percent. The blends also typically will display a VI of between about 130 and about 185 and will have very low total sulfur, usually less than about 5 ppm. Most noticeably, the lubricating base oils compositions of the invention display unique boiling range distributions.

The boiling range distributions characteristic of the lubricating base oils prepared according to the invention will depend to some extent on the properties of the Fischer-Tropsch derived bottoms fraction used in preparing the blend. In general, the lubricating base oils of the invention will have an initial boiling point within the range of between about 550 degrees F. (288 degrees C.) and about 625 degrees F. (330 degrees C.) and an end boiling point between about 1000 degrees F. (538 degrees C.) and about 1400 degrees F. (760 degrees C.). In addition, lubricating base oils of the invention will typically display a bi-modal boiling range distribution which may be described as a lubricating base oil blend in which less than 20 weight percent of the blend will boil within the region defined by the 50 percent boiling points, plus or minus 30 degrees F.

All boiling range distributions in this disclosure are measured using the standard analytical method D-6352 or its equivalent unless stated otherwise. As used herein, a equivalent analytical method to D-6352 refers to any analytical method which gives substantially the same results as the standard method.

The Fischer-Tropsch derived lubricating base oil blends prepared according to the present invention also may be blended with conventionally derived lubricating base oils, such as conventional neutral Group I and Group II lubricating base oils. When the Fischer-Tropsch derived lubricating base oil is blended with a conventional neutral Group I or Group II base oil, the conventional base oil will typically comprise between about 40 weight percent and about 90 weight percent of the total blend, with from about 40 weight percent to about 70 weight percent being preferred.

The Fischer-Tropsch derived lubricating base oil blends of the invention may also be blended with synthetic lubricants, such as esters (mono-, di-, dimer-, polyol-, and aromatic), polyalphaolefins. Polyphenyl ethers and polygycols.

Lubricating base oil blends of the invention represent premium lubricants which may be used to prepare finished lubricants. A finished lubricant, such as, for example, a commercial multi-grade crankcase lubricating oil meeting SAE J300, June 2001 specifications, may be prepared from the lubricating base oil blends of the invention by the addition of the proper additives. Typical additives added to a lubricating base oil blend when preparing a finished lubricant include anti-wear additives, detergents, dispersants, antioxidants, pour point depressants, VI improvers, friction modifiers, demulsifiers, antifoaming agents, corrosion inhibitors, seal swell agents, and the like. In addition, commercial products meeting SAE standards for gear lubricants, NLGI Mark GC and LB for greases, and ISO Viscosity Grade standards for industrial oils may be prepared from the Fischer-Tropsch derived lubricating base oils of the invention.

DETAILED DESCRIPTION OF THE INVENTION

Noack volatility of engine oil, as measured by TGA Noack and similar methods, has been found to correlate with oil consumption in passenger car engines. Strict requirements for low volatility are important aspects of several recent engine oil specifications, such as, for example, ACEA A-3 and B-3 in Europe and ILSAC GF-3 in North America. Due to the high volatility of conventional low viscosity oils with kinematic viscosities below 3 cSt at 100 degrees C., they have limited their use in passenger car engine oils. Any new lubricating base oil stocks developed for use in automotive engine oils should have a volatility no greater than current conventional Group I or Group II light neutral oils.

Fischer-Tropsch wax processing typically produces a relatively high proportion of products of low molecular weight and low viscosity that are processed into light products such as naphtha, gasoline, diesel, fuel oil, or kerosene. A proportion of products have kinematic viscosities above 3.0 cSt which are useful directly as lubricating base oils for many different products, including engine oils. Those base oils with kinematic viscosities between 2.1 and 2.8 cSt typically are further processed into lighter products (e.g., gasoline or diesel) in order to be of much economic value. Alternatively, these low viscosity Fischer-Tropsch derived base oils may be used in light industrial oils, such as, for example, utility oils, transformer oils, pump oils, or hydraulic oils; many of which have less stringent volatility requirements, and all of which are in much lower demand than engine oils.

Lubricating base oils for use in engine oils are in higher demand than those for use in light products. The ability to use a higher proportion of the products from Fischer-Tropsch processes in lubricating base oil blends for engine oils is highly desirable. By virtue of the present invention, Fischer-Tropsch derived lubricating base oils characterized by low viscosity are blended with a Fischer-Tropsch derived bottoms fraction to produce compositions which are useful as a lubricating base oil for preparing engine oil. The lubricating base oil stocks of this invention are comparable in volatility and viscosity to conventional Group I and Group II neutral oils. In addition, lubricating base oils of the invention also have other improved properties, such as very low sulfur and exceptional oxidation stability.

Fischer-Tropsch Synthesis

During Fischer-Tropsch synthesis liquid and gaseous hydrocarbons are formed by contacting a synthesis gas (syngas) comprising a mixture of hydrogen and carbon monoxide with a Fischer-Tropsch catalyst under suitable temperature and pressure reactive conditions. The Fischer-Tropsch reaction is typically conducted at temperatures of from about 300 degrees to about 700 degrees F. (about 150 degrees to about 370 degrees C.) preferably from about 400 degrees to about 550 degrees F. (about 205 degrees to about 290 degrees C.); pressures of from about 10 to about 600 psia, (0.7 to 41 bars) preferably 30 to 300 psia, (2 to 21 bars) and catalyst space velocities of from about 100 to about 10,000 cc/g/hr., preferably 300 to 3,000 cc/g/hr.

The products from the Fischer-Tropsch synthesis may range from $C_1$ to $C_{200}$ plus hydrocarbons with a majority in the $C_5$–$C_{100}$ plus range. The reaction can be conducted in a variety of reactor types, such as, for example, fixed bed reactors containing one or more catalyst beds, slurry reactors, fluidized bed reactors, or a combination of different types of reactors. Such reaction processes and reactors are well known and documented in the literature. The slurry Fischer-Tropsch process, which is preferred in the practice of the invention, utilizes superior heat (and mass) transfer characteristics for the strongly exothermic synthesis reaction and is able to produce relatively high molecular weight paraffinic hydrocarbons when using a cobalt catalyst. In the slurry process, a syngas comprising a mixture of hydrogen and carbon monoxide is bubbled up as a third phase through a slurry which comprises a particulate Fischer-Tropsch type hydrocarbon synthesis catalyst dispersed and suspended in a slurry liquid comprising hydrocarbon products of the synthesis reaction which are liquid under the reaction conditions. The mole ratio of the hydrogen to the carbon monoxide may broadly range from about 0.5 to about 4, but is more typically within the range of from about 0.7 to about 2.75 and preferably from about 0.7 to about 2.5. A particularly preferred Fischer-Tropsch process is taught in European Patent Application No. 0609079, also completely incorporated herein by reference for all purposes.

Suitable Fischer-Tropsch catalysts comprise one or more Group VIII catalytic metals such as Fe, Ni, Co, Ru and Re, with cobalt being preferred. Additionally, a suitable catalyst may contain a promoter. Thus, a preferred Fischer-Tropsch catalyst comprises effective amounts of cobalt and one or more of Re, Ru, Pt, Fe, Ni, Th, Zr, Hf, U, Mg and La on a suitable inorganic support material, preferably one which comprises one or more refractory metal oxides. In general, the amount of cobalt present in the catalyst is between about 1 and about 50 weight percent of the total catalyst composition. The catalysts can also contain basic oxide promoters such as $ThO_2$, $La_2O_3$, MgO, and $TiO_2$, promoters such as $ZrO_2$, noble metals (Pt, Pd, Ru, Rh, Os, Ir), coinage metals (Cu, Ag, Au), and other transition metals such as Fe, Mn, Ni, and Re. Suitable support materials include alumina, silica, magnesia and titania or mixtures thereof. Preferred supports for cobalt containing catalysts comprise titania. Useful catalysts and their preparation are known and illustrated in U.S. Pat. No. 4,568,663, which is intended to be illustrative but non-limiting relative to catalyst selection.

The products as they are recovered from the Fischer-Tropsch operation usually may be divided into three fractions, a gaseous fraction consisting of very light products, a condensate fraction generally boiling in the range of naphtha and diesel, and a high boiling Fischer-Tropsch wax fraction which is normally solid at ambient temperatures. The Fischer-Tropsch derived products used to prepare base oils are usually prepared from the waxy fractions of the Fischer-Tropsch syncrude by hydrotreating and/or hydroisomerization. Other methods which may be used in preparing the base oils include oligomerization, solvent dewaxing, atmospheric and vacuum distillation, hydrocracking, hydrofinishing, and other forms of hydroprocessing.

Hydroisomerization and Solvent Dewaxing

Hydroisomerization, or for the purposes of this disclosure simply "isomerization", is intended to improve the cold flow properties of the Fischer-Tropsch derived product by the selective addition of branching into the molecular structure. Isomerization ideally will achieve high conversion levels of the Fischer-Tropsch wax to non-waxy iso-paraffins while at the same time minimizing the conversion by cracking. Since wax conversion can be complete, or at least very high, this process typically does not need to be combined with additional dewaxing processes to produce a lubricating oil base stock with an acceptable pour point. Isomerization operations suitable for use with the present invention typically uses a catalyst comprising an acidic component and may optionally contain an active metal component having hydrogenation activity. The acidic component of the catalysts preferably includes an intermediate pore SAPO, such as SAPO-11, SAPO-31, and SAPO-41, with SAPO-11 being particularly preferred. Intermediate pore zeolites, such as ZSM-22, ZSM-23, SSZ-32, ZSM-35, and ZSM-48, also may be used in carrying out the isomerization. Typical active metals include molybdenum, nickel, vanadium, cobalt, tungsten, zinc, platinum, and palladium. The metals platinum and palladium are especially preferred as the active metals, with platinum most commonly used.

The phrase "intermediate pore size", when used herein, refers to an effective pore aperture in the range of from about 4.0 to about 7.1 Angstrom when the porous inorganic oxide is in the calcined form. Molecular sieves having pore apertures in this range tend to have unique molecular sieving characteristics. Unlike small pore zeolites such as erionite and chabazite, they will allow hydrocarbons having some branching into the molecular sieve void spaces. Unlike larger pore zeolites such as faujasites and mordenites, they are able to differentiate between n-alkanes and slightly branched alkenes, and larger alkanes having, for example, quaternary carbon atoms. See U.S. Pat. No. 5,413,695. The term "SAPO" refers to a silicoaluminophosphate molecular sieve such as described in U.S. Pat. Nos. 4,440,871 and 5,208,005.

In preparing those catalysts containing a non-zeolitic molecular sieve and having an hydrogenation component, it is usually preferred that the metal be deposited on the catalyst using a non-aqueous method. Non-zeolitic molecular sieves include tetrahedrally-coordinated [AlO2 and PO2] oxide units which may optionally include silica. See U.S. Pat. No. 5,514,362. Catalysts containing non-zeolitic molecular sieves, particularly catalysts containing SAPO's, on which the metal has been deposited using a non-aqueous method have shown greater selectivity and activity than those catalysts which have used an aqueous method to deposit the active metal. The non-aqueous deposition of active metals on non-zeolitic molecular sieves is taught in U.S. Pat. No. 5,939,349. In general, the process involves dissolving a compound of the active metal in a non-aqueous, non-reactive solvent and depositing it on the molecular sieve by ion exchange or impregnation.

Solvent dewaxing attempts to remove the waxy molecules from the product by dissolving them in a solvent, such as methyl ethyl ketone, methyl iso-butyl ketone, or toluene, and precipitating the wax molecules and then removing them by filtration as discussed in Chemical Technology of Petroleum, 3$^{rd}$ Edition, William Gruse and Donald Stevens, McGraw-Hill Book Company, Inc., New York, 1960, pages 566–570. See also U.S. Pat. Nos. 4,477,333; 3,773,650; and 3,775,288. In general, with the present invention isomerization is usually preferred over solvent dewaxing, since it results in higher viscosity index products with improved low temperature properties, and in higher yields of the products boiling within the range of the light distillate fraction and the heavy fraction. However solvent dewaxing may be advantageously used in combination with isomerization to recover unconverted wax following isomerization.

Hydrotreating, Hydrocracking, and Hydrofinishing

Hydrotreating refers to a catalytic process, usually carried out in the presence of free hydrogen, in which the primary purpose is the removal of various metal contaminants, such as arsenic; heteroatoms, such as sulfur and nitrogen; or aromatics from the feed stock. Generally, in hydrotreating operations cracking of the hydrocarbon molecules, i.e., breaking the larger hydrocarbon molecules into smaller hydrocarbon molecules, is minimized, and the unsaturated hydrocarbons are either fully or partially hydrogenated.

Hydrocracking refers to a catalytic process, usually carried out in the presence of free hydrogen, in which the cracking of the larger hydrocarbon molecules is the primary purpose of the operation. Desulfurization and/or denitrification of the feedstock also usually will occur. Although typically hydrocracking operations will usually be limited to the cracking of the heaviest bottoms material, in the present invention it is one method that may be used to increase amount of olefins present in the Fischer-Tropsch condensate recovered from the Fischer-Tropsch synthesis operation. The olefin enriched distillate fraction produced from the condensate may be oligomerized to prepare bright stock which is blended with the light fraction to prepare lubricating base oils within the scope of the invention.

Catalysts used in carrying out hydrotreating and hydrocracking operations are well known in the art. See for example U.S. Pat. Nos. 4,347,121 and 4,810,357, the contents of which are hereby incorporated by reference in their entirety, for general descriptions of hydrotreating, hydrocracking, and of typical catalysts used in each of the processes. Suitable catalysts include noble metals from Group VIIIA (according to the 1975 rules of the International Union of Pure and Applied Chemistry), such as platinum or palladium on an alumina or siliceous matrix, and Group VIII and Group VIB, such as nickel-molybdenum or nickel-tin on an alumina or siliceous matrix. U.S. Pat. No. 3,852,207 describes a suitable noble metal catalyst and mild conditions. Other suitable catalysts are described, for example, in U.S. Pat. Nos. 4,157,294 and 3,904,513. The non-noble hydrogenation metals, such as nickel-molybdenum, are usually present in the final catalyst composition as oxides, but are usually employed in their reduced or sulfided forms when such sulfide compounds are readily formed from the particular metal involved. Preferred non-noble metal catalyst compositions contain in excess of about 5 weight percent, preferably about 5 to about 40 weight percent molybdenum and/or tungsten, and at least about 0.5, and generally about 1 to about 15 weight percent of nickel and/or cobalt determined as the corresponding oxides. Catalysts containing noble metals, such as platinum, contain in excess of 0.01 percent metal, preferably between 0.1 and 1.0 percent metal. Combinations of noble metals may also be used, such as mixtures of platinum and palladium.

The hydrogenation components can be incorporated into the overall catalyst composition by any one of numerous procedures. The hydrogenation components can be added to matrix component by co-mulling, impregnation, or ion exchange and the Group VI components, i.e.; molybdenum and tungsten can be combined with the refractory oxide by impregnation, co-mulling or co-precipitation.

The matrix component can be of many types including some that have acidic catalytic activity. Ones that have activity include amorphous silica-alumina or zeolitic or non-zeolitic crystalline molecular sieves. Examples of suitable matrix molecular sieves include zeolite Y, zeolite X and the so called ultra stable zeolite Y and high structural silica-alumina ratio zeolite Y such as that described in U.S. Pat. Nos. 4,401,556; 4,820,402; and 5,059,567. Small crystal size zeolite Y, such as that described in U.S. Pat. No. 5,073,530 can also be used. Non-zeolitic molecular sieves which can be used include, for example, silicoaluminophosphates (SAPO), ferroaluminophosphate, titanium aluminophosphate and the various ELAPO molecular sieves described in U.S. Pat. No. 4,913,799 and the references cited therein. Details regarding the preparation of various non-zeolite molecular sieves can be found in U.S. Pat. No. 5,114,563 (SAPO) and U.S. Pat. No. 4,913,799 and the various references cited in U.S. Pat. No. 4,913,799. Mesoporous molecular sieves can also be used, for example the M41S family of materials as described in *J. Am. Chem. Soc.*, 114:10834–10843(1992)), MCM-41; U.S. Pat. Nos. 5,246,689; 5,198,203; and 5,334,368; and MCM-48 (Kresge et al., *Nature* 359:710 (1992)). Suitable matrix materials may also include synthetic or natural substances as well as inorganic materials such as clay, silica and/or metal oxides such as silica-alumina, silica-magnesia, silica-zirconia, silica-thoria, silica-berylia, silica-titania as well as ternary compositions, such as silica-alumina-thoria, silica-alumina-zirconia, silica-alumina-magnesia, and silica-magnesia zirconia. The lafter may be either naturally occurring or in the form of gelatinous precipitates or gels including mixtures of silica and metal oxides. Naturally occurring clays which can be composited with the catalyst include those of the montmorillonite and kaolin families. These clays can be used in the raw state as originally mined or initially subjected to dealumination, acid treatment or chemical modification.

In performing the hydrocracking and/or hydrotreating operation, more than one catalyst type may be used in the reactor. The different catalyst types can be separated into layers or mixed.

Hydrocracking conditions have been well documented in the literature. In general, the overall LHSV is about 0.1 $hr^{-1}$ to about 15.0 $hr^{-1}$ (v/v), preferably from about 0.25 $hr^{-1}$ to about 2.5 $hr^{-1}$. The reaction pressure generally ranges from about 500 psig to about 3500 psig (about 10.4 MPa to about 24.2 MPa, preferably from about 1500 psig to about 5000 psig (about 3.5 MPa to about 34.5 MPa). Hydrogen consumption is typically from about 500 to about 2500 SCF per barrel of feed (89.1 to 445 $m^3$ H2/$m^3$ feed). Temperatures in the reactor will range from about 400 degrees F. to about 950 degrees F. (about 204 degrees C. to about 510 degrees C.), preferably ranging from about 650 degrees F. to about 850 degrees F. (about 343 degrees C. to about 454 degrees C.).

Typical hydrotreating conditions vary over a wide range. In general, the overall LHSV is about 0.25 to 2.0, preferably about 0.5 to 1.0. The hydrogen partial pressure is greater than 200 psia, preferably ranging from about 500 psia to about 2000 psia. Hydrogen recirculation rates are typically greater than 50 SCF/Bbl, and are preferably between 1000 and 5000 SCF/Bbl. Temperatures in the reactor will range from about 300 degrees F. to about 750 degrees F. (about 150 degrees C. to about 400 degrees C.), preferably ranging from 450 degrees F. to 600 degrees F. (230 degrees C. to about 315 degrees C.).

Hydrotreating may also be used as a final step in the lube base oil manufacturing process. This final step, commonly called hydrofinishing, is intended to improve the UV stability and appearance of the product by removing traces of aromatics, olefins, color bodies, and solvents. As used in this disclosure, the term UV stability refers to the stability of the lubricating base oil or the finished lubricant when exposed to UV light and oxygen. Instability is indicated when a visible precipitate forms, usually seen as floc or cloudiness, or a darker color develops upon exposure to ultraviolet light and air. A general description of hydrofinishing may be found in U.S. Pat. Nos. 3,852,207 and 4,673,487. Clay treating to remove these impurities is an alternative final process step.

Thermal Cracking

Thermal cracking may also be employed to crack the paraffin molecules into lower molecular weight olefins in order to olefin enrich the Fischer-Tropsch condensate. As already noted, all Fischer-Tropsch syncrude as initially recovered from the Fischer-Tropsch synthesis will contain olefins. By thermal cracking the paraffin molecules present in the condensate fraction the amount of olefins present may be significantly increased. Following the thermal cracking operation the condensate fraction should have an olefinicity of at least 20 percent by weight, preferably at least 40 percent by weight, and most preferably at least 50 percent by weight.

Although batch pyrolysis reactors, such as employed in delayed coking or in cyclic batch operations, could be used to carry out this operation, generally a continuous flow-through operation is preferred in which the feed is first preheated to a temperature sufficient to vaporize most or all of the feed after which the vapor is passed through a tube or tubes. A desirable option is to bleed any remaining nonvaporized hydrocarbons prior to entering the tubes in the cracking furnace. Preferably, the thermal cracking is conducted in the presence of steam which serves as a heat source and also helps suppress coking in the reactor. Details of a typical steam thermal cracking process may be found in U.S. Pat. No. 4,042,488, hereby incorporated by reference in its entirety. Although catalyst is generally not used in carrying out the thermal cracking operation, it is possible to conduct the operation in a fluidized bed in which the vaporized feed is contacted with hot fluidized inert particles, such as fluidized particles of coke.

In performing the thermal cracking operation, it is preferable that the feed be maintained in the vapor phase during the cracking operation to maximize the production of olefins. Liquid phase cracking results in the formation of significant amounts of paraffins which are unreactive in the oligomerization operation and, therefore, are not desired. In the pyrolysis zone, the cracking conditions should be sufficient to provide a cracking conversion of greater than about 30 percent by weight of the paraffins present. Preferably, the cracking conversion will be at least 50 percent by weight and most preferably at least 70 percent by weight. The optimal temperature and other conditions in the pyrolysis zone for the cracking operation will vary somewhat depending on the feed. In general, the temperature must be high enough to maintain the feed in the vapor phase but not so high that the feed is overcracked, i.e., the temperature and conditions should not be so severe that excessive $C_4$ minus hydrocarbons are generated. The temperature in the pyrolysis zone normally will be maintained at a temperature of between about 950 degrees F. (510 degrees C.) and about 1600 degrees F. (870 degrees C.). The optimal temperature range for the pyrolysis zone in order to maximize the production of olefins from the Fischer-Tropsch wax will depend upon the endpoint of the feed. In general, the higher the carbon number, the higher the temperature required to achieve maximum conversion. Accordingly, some routine experimentation may be necessary to identify the optimal cracking conditions for a specific feed. The pyrolysis zone usually will employ pressures maintained between about 0 atmospheres and about 5 atmospheres, with pressures in the range of from about 0 to about 2 generally being preferred. Although the optimal residence time of the wax fraction in the reactor will vary depending on the temperature and pressure in the pyrolysis zone, typical residence times are generally in the range of from about 1.5 seconds to about 500 seconds, with the preferred range being between about 5 seconds and about 300 seconds.

Oligomerization

Depending upon how the Fischer-Tropsch synthesis is carried out, the Fischer-Tropsch condensate will contain varying amounts of olefins. In addition, most Fischer-Tropsch condensate will contain some alcohols which may be readily converted into olefins by dehydration. As already noted, the condensate may also be olefin enriched through a cracking operation, either by means of hydrocracking or more preferably by thermal cracking. In one embodiment of the present invention these olefins may be oligomerized to produce a Fischer-Tropsch derived bright stock. During oligomerization the lighter olefins are not only converted into heavier molecules, but the carbon backbone of the oligomers will also display branching at the points of molecular addition. Due to the introduction of branching into the molecule, the pour point of the products is reduced.

The oligomerization of olefins has been well reported in the literature, and a number of commercial processes are available. See, for example, U.S. Pat.

Nos. 4,417,088; 4,434,308; 4,827,064; 4,827,073; and 4,990,709. Various types of reactor configurations may be employed, with the fixed catalyst bed reactor being used commercially. More recently, performing the oligomerization in an ionic liquid media has been proposed, since these catalysts are very active, and the contact between the catalyst and the reactants is efficient and the separation of the catalyst from the oligomerization products is facilitated. The oligomerization reaction will proceed over a wide range of conditions. Typical temperatures for carrying out the reaction are between about 32 degrees F. (0 degrees C.) and about 800 degrees F. (425 degrees C.). Other conditions include a space velocity from 0.1 to 3 LHSV and a pressure from 0 to 2000 psig. Catalysts for the oligomerization reaction can be virtually any acidic material, such as, for example, zeolites, clays, resins, $BF_3$ complexes, HF, $H_2SO_4$, $AlCl_3$, ionic liquids (preferably ionic liquids containing a Bronsted or Lewis acidic component or a combination of Bronsted and Lewis acid components), transition metal-based catalysts (such as $Cr/SiO_2$), superacids, and the like. In addition, non-acidic oligomerization catalysts including certain organometallic or transition metal oligomerization catalysts may be used, such as, for example, zirconocenes.

Distillation

The separation of the Fischer-Tropsch derived products into the various fractions used in the process of the invention is generally conducted by either atmospheric or vacuum distillation or by a combination of atmospheric and vacuum distillation. Atmospheric distillation is typically used to separate the lighter distillate fractions, such as naphtha and middle distillates, from a bottoms fraction having an initial boiling point above about 700 degrees F. to about 750 degrees F. (about 370 degrees C. to about 400 degrees C.). At higher temperatures thermal cracking of the hydrocarbons may take place leading to fouling of the equipment and to lower yields of the heavier cuts. Vacuum distillation is typically used to separate the higher boiling material, such as the lubricating base oil fractions.

As used in this disclosure, the term "distillate fraction" or "distillate" refers to a side stream product recovered either from an atmospheric fractionation column or from a vacuum column as opposed to the "bottom fraction" which represents the residual higher boiling fraction recovered from the bottom of the column. In this disclosure, the term "bottoms" also includes those bottoms fractions and bright stock derived from the oligomerization of olefins present in the Fischer-Tropsch condensate.

The Distillate Fraction

The distillate fraction used to prepare the lubricating base oil product of the invention represents a distillate fraction of the Fischer-Tropsch derived product as defined above. Distillate fractions used in carrying out the invention and the Fischer-Tropsch derived lubricating base oil blends of the invention may be characterized by their true boiling point (TBP) and by their boiling range distribution. For the purposes of this disclosure, unless stated otherwise, TBP and boiling range distributions for a distillate fraction are measured by gas chromatography according to ASTM D-6352 or its equivalent.

A critical property of the distillate fractions of the invention is viscosity. The distillate fraction must have a kinematic viscosity of about 2 or greater but less than 3 cSt at 100 degrees C., more preferably between about 2.1 and 2.8 cSt at 100 degrees C., and most preferably between about 2.2 and 2.7 cSt at 100 degrees C.

Another critical property of the distillate fractions and the lubricating base oil products of the invention is volatility which is expressed as Noack volatility, Noack volatility is defined as the mass of oil, expressed in weight percent, which is lost when the oil is heated at 250 degrees C. and 20 mmHg (2.67 kPa; 26.7 mbar) below atmospheric in a test crucible through which a constant flow of air is drawn for 60 minutes (ASTM D-5800). A more convenient method for calculating Noack volatility and one which correlates well with ASTM D-5800 is by using a thermo gravimetric analyzer test (TGA) by ASTM D-6375. TGA Noack volatility is used throughout this disclosure unless otherwise stated. As already noted above, the first distillate fraction of the invention while having a viscosity below 3 cSt at 100 degrees C. displays a significantly lower TGA Noack volatility than would be expected when compared to conventional petroleum-derived distillates having a comparable viscosity. This makes it possible to blend the low viscosity first distillate fraction with the higher viscosity second distillate fraction and still meet the volatility specifications for the lube base oil and the finished lubricant.

The Bottoms Fraction

The Fischer-Tropsch derived bottoms fraction represents a high viscosity high boiling fraction. Typically, the bottom fraction will have a kinematic viscosity of at least 9 cSt at 100 degrees C. Fischer-Tropsch derived bottoms other than bright stock will usually have a kinematic viscosity between about 9 cSt and about 20 cSt at 100 degrees C., with a kinematic viscosity of between about 10 cSt and about 16 cSt being preferred. The bottom fraction will contain a large percent of Fischer-Tropsch wax and usually will be solid at room temperature. In order to improve its properties prior to being blended with the distillate fraction, it may be advantageous to further process the bottom fraction. For example, the bottom fraction may be hydrotreated to saturate the double bonds and remove any impurities, such as any oxygenates, that may be present. The bottoms fraction may also be isomerized to improve its cold flow properties.

The Fischer-Tropsch derived bright stock may be prepared by highly refining the waxy bottom fraction recovered directly from a Fischer-Tropsch plant. However, since the Fischer-Tropsch syncrude usually does not comprise a large proportion of heavy products, it may be desirable to prepare at least part of the bright stock through the oligomerization of the olefins present in the Fischer-Tropsch condensate. The enrichment of the Fischer-Tropsch condensate with olefins and the oligomerization of the olefins to produce larger molecules has already been discussed. Typically, the processing of Fischer-Tropsch derived materials to yield bright stock will include dewaxing, hydrofinishing, and fractionation. As already noted, Fischer-Tropsch bright stock is a high viscosity material having a kinematic viscosity within the range of from about 15 cSt to about 40 cSt at 100 degrees F.

Lubricating Base Oil Blends

Lubricating base oils are generally materials having a viscosity greater than 3 cSt at 100 degrees C.; a pour point below 20 degrees C., preferably below 0 degrees C.; and a VI of greater than 70, preferably greater than 90. As explained below and illustrated in the examples, the lubricating base oil blends prepared according to the process of the present invention meet these criteria. In addition, the lubricating base oils of the invention display a unique combination of properties which could not have been predicted from a review of the prior art relating to both conventional and Fischer-Tropsch materials. The invention takes advantage of the high VI of the light distillate fraction which when blended with the heavier fraction will result in a final blend having a viscosity which is within acceptable limits for use as a lubricating base oil.

Lubricating base oils within the scope of the invention will generally have a kinematic viscosity between about 3 and about 10 cSt at 100 degrees C. Generally the lubricating base oil will be blended to a pre-selected target viscosity which is suitable for preparing a finished lubricant intended for a particular application. Obviously the proportions of the various distillate and heavy fractions in the blend will need to be adjusted to meet this desired target viscosity in the lubricating base oil blend. The exact ratio of each of the fractions in the final blend will depend on the exact viscosity of each fraction and the target viscosity desired for the lubricating base oil, as well as other desired properties such as, for example, VI, volatility, pour point, cloud point and the like.

The lubricating base oil formed by the blending of the distillate fraction and the heavy fraction is characterized as having a viscosity between about 3 and about 10 cSt at 100 degrees C. and a TGA Noack volatility of less than about 45 weight percent. Generally, the lubricating base oil will have a viscosity between about 4 cSt and about 8 cSt at 100 degrees C. and a Noack volatility greater than about 12 weight percent. Commonly the Noack volatility will be greater than about 20 weight percent. However, if the lubricating base oil blend is intended for use in formulating a crankcase lubricating oil, the Noack volatility preferably will be less than about 30 weight percent. Volatility of the Fischer-Tropsch derived lubricating base oil blends of the invention are acceptable and are comparable to conventional petroleum derived lubricating base oils which is surprising given the low viscosity of the distillate fraction. The use of a comparable petroleum derived base oil in a lubricating base oil blend would result in an unacceptably high Noack volatility. Generally, the viscosity index (VI) of the Fischer-Tropsch derived lubricating base oil blend will be between about 130 and about 185. VI is an expression of the effect of temperature on viscosity, and it is surprising that a lubricating base oil blend prepared using a base oil having a viscosity of less than 3 cSt at 100 degrees C. will be characterized by such a favorable VI. As noted previously, it is even more surprising that the blends of the invention often realize a VI premium, i.e., the VI of the lubricating base oil blend is higher than would be expected from an averaging of VI of the light distillate fraction with that of the heavy fraction. Since Fischer-Tropsch derived hydrocarbons are typically very low in total sulfur, the total sulfur content of the lubricating base oil usually will be less than about 5 ppm. Conventionally-derived, solvent processed lubricating base oils will generally display much higher sulfur levels, usually in excess of 2000 ppm.

Lubricating base oil blends within the scope of the invention will generally have a boiling range distribution of at least 450 degrees F. (about 232 degrees C.). Typically, the Fischer-Tropsch derived lubricating base oil blend will have an initial boiling point within the range of between about 550 degrees F. (288 degrees C.) and about 625 degrees F. (330 degrees C.), an end boiling point between about 1000 degrees F. (538 degrees C.) and about 1400 degrees F. (760 degrees C.), and wherein less than 20 weight percent of the blend boils within the region defined by the 50 percent boiling point, plus or minus 30 degrees F. (16.7 degrees C.). The boiling range distribution of the lubricating base oils of the invention are significantly broader than those observed for conventional lubricating base oils. The boiling range for conventionally derived lubricating base oils typically will not exceed about 250 degrees F. (about 139 degrees C.). In this disclosure when referring to boiling range distribution, the boiling range between the 5 percent and 95 percent boiling points is what is referred to.

Pour point is the temperature at which a sample of the lubricating base oil will begin to flow under carefully controlled conditions. In this disclosure, where pour point is given, unless stated otherwise, it has been determined by standard analytical method ASTM D-5950. Lubricating base oils prepared according to the present invention have excellent pour points which are comparable or even below the pour points observed for conventionally derived lubricating base oils. In addition, the blends containing the distillate fraction and bright stock have been observed to display a cloud point premium, i.e., the cloud point is significantly lower than would have been predicted from the mere averaging of the cloud points of the two components making up the blend. In some cases the cloud point will actually be significantly lower than the cloud point of either component. Preferably the cloud point of such blends will be −15 degrees C. or less. Finally, due to the extremely low aromatics and multi-ring naphthene levels of blends of Fischer-Tropsch derived lubricating base oils; their oxidation stability far exceeds that of conventional lubricating base oil blends.

A useful property of lubricating base oils and finished lubricants intended for use in automobile engine oils is measured by cold-cranking simulator (CCS) apparent viscosity which correlates with low temperature cranking. It is measured by ASTM D5293 at a set temperature between −10 and −35 degrees C. Engine oil specifications, e.g., SAE J300, include maximum limits for CCS Viscosity for multi-grade engine oils. For a finished lubricant within the scope of the invention the cold-cranking simulator (CCS) apparent viscosity should be less than 7000 cP at −25 degrees C. and preferably of 6500 cP or less at −25 degrees C. if the lubricant is intended for use as a multi-grade engine oil in an automobile engine.

Finished Lubricants

Finished lubricants generally comprise a lubricating base oil and at least one additive. Finished lubricants are used in automobiles, diesel engines, gas engines, axles, transmissions, and industrial applications. As noted above, finished lubricants must meet the specifications for their intended application as defined by the concerned governing organization. Lubricating base oils of the present invention have been found to be suitable for formulating finished lubricants intended for many of these applications. For example, lubricating base oils of the present invention may be utilized in formulations to meet SAE J300, June 2001 specifications for 10W-XX, and 15W-XX multi-grade crankcase lubricating oils. Although some multi-grade crankcase oils meeting may be formulated using only Fischer-Tropsch lubricating base oils prepared according to the present invention, in order to meet the specifications for some 10W-XX and most 15W-XX, it may be desirable that the Fischer-Tropsch derived lubricating base oil be blended with a conventional petroleum derived lubricating base oil, such as a conventional neutral Group I or Group II base oil to meet the specifications. Typically, when present the conventional neutral Group I or Group II base oil will comprise from about 40 to about 90 weight percent of the lubricating base oil blend, more preferably from about 40 to about 70 weight percent. Also Fischer-Tropsch derived lubricating oils of the invention may be used to formulate mono-grade engine oils, such as SAE 20 or SAE 30, which are heavily used in many parts of the world where low temperature performance is not critical. In addition, Fischer-Tropsch derived lubricating base oils of the invention may be used to formulate finished lubricants meeting the specifications for automatic transmission fluids, NLGI Mark GC and LB greases, and ISO Viscosity Grade 22, 32, and 46 industrial oils.

The lubricating base oil compositions of the invention may also be used as a blending component with other oils. For example, the Fischer-Tropsch derived lubricating base oils may be used as a blending component with synthetic base oils, such as esters (mono-, di-, dimer, polyol-, and aromatic), polyalphaolefins, polyphenyl ethers, and polyglycols to improve the viscosity and viscosity index properties of those oils. The Fischer-Tropsch derived base oils may be combined with isomerized petroleum wax. They may also be used as workover fluids, packer fluids, coring fluids, completion fluids, and in other oil field and well-servicing applications. For example, they can be used as spotting fluids to release a drill pipe which has become stuck, or they can be used to replace part or all of the expensive polyalphaolefin lubricating additives in downhole applications. Additionally, Fischer-Tropsch derived lubricating base oils may be used in drilling fluid formulations where shale-swelling inhibition is important, such as described in U.S. Pat. No. 4,941,981.

Additives which may be blended with the lubricating base oil to form the finished lubricant composition include those which are intended to improve certain properties of the finished lubricant. Typical additives include, for example, anti-wear additives, detergents, dispersants, antioxidants, pour point depressants, VI improvers, friction modifiers, demulsifiers, antifoaming agents, corrosion inhibitors; seal swell agents, and the like. Other hydrocarbons, such as those described in U.S. Pat. Nos. 5,096,883 and 5,189,012, may be blended with the lubricating base oil provided that the finished lubricant has the necessary pour point, kinematic viscosity, flash point, and toxicity properties. Typically, the total amount of additives in the finished lubricant will fall within the range of from about 1 to about 30 weight percent. However due to the excellent properties of the Fischer-Tropsch derived lubricating base oils of the invention, less additives than required with conventional petroleum derived base oils may be required to meet the specifications for the finished lubricant. The use of additives in formulating finished lubricants is well documented in the literature and well within the ability of one skilled in the art. Therefore, additional explanation should not be necessary in this disclosure.

EXAMPLES

The following examples are included to further clarify the invention but are not to be construed as limitations on the scope of the invention.

Example 1

Two Fisher-Tropsch distillate fractions (designated FT-2.2 and FT-2.4, respectively) having kinematic viscosities between 2 and 3 cSt at 100 degrees C. were recovered from a Fischer-Tropsch syncrude prepared using a cobalt-based catalyst. Each fraction was analyzed and their properties were compared to two commercially available conventional petroleum derived oils (Nexbase 3020 and Pennzoil 75HC) having viscosities within the same general range. A comparison between the properties of the four samples is shown below:

| | FT-2.2 | FT-2.4 | Nexbase 3020 | Pennzoil 75HC |
|---|---|---|---|---|
| Vis. @ 100° C. (cSt) | 2.18 | 2.399 | 2.055 | 2.885 |
| Viscosity Index (VI) | 123 | 125 | 96 | 80 |
| Pour Point, C. | −37 | −33 | −51 | −38 |
| Noack (wt. %) | 52.3 | 56.64 | 75.1 | 59.1 |

It should be noted that, although the viscosity at 100 degrees C. of the two Fischer-Tropsch derived materials were comparable to those of the conventional oils, the VI is surprisingly high, which results in a much lower volatility for a given viscosity.

Example 2

A Fisher-Tropsch bottom fraction, designated FT-14, was recovered from a Fischer-Tropsch syncrude prepared using an iron-based catalyst. The bottom fraction was subsequently hydrotreated. The properties of FT-14 were as follows:

| | |
|---|---|
| Viscosity at 100 degrees C. (cSt) | 14.62 |
| Viscosity Index (VI) | 160 |
| Pour Point, C. | −1 |

Example 3

Two different Fischer-Tropsch derived lubricating base oil blends were prepared by blending different proportions of the FT-2.4 from example 1 and FT-14 from example 2. The proportions of FT-2.4 and FT-14 in each blend are shown in Table 1 below:

TABLE 1

| | Wt % FT-2.2 | Wt % FT-14 |
|---|---|---|
| Lubricating Base Oil A | 60 | 40 |
| Lubricating Base Oil B | 35 | 65 |

The properties for each of the lubricating base oil blends are summarized in Table 2 below:

TABLE 2

| | Lubricating Base Oil A | Lubricating Base Oil B |
|---|---|---|
| D-2887 Simulated TBP (WT %), ° F. | | |
| TBP @0.5 (Initial Boiling Point) | 593 | 596 |
| TBP @5 | 616 | 634 |
| TBP @10 | 630 | 659 |
| TBP @20 | 656 | 708 |
| TBP @30 | 680 | 765 |
| TBP @40 | 705 | 1015 |
| TBP @50 | 730 | 1032 |
| TBP @60 | 760 | 1049 |
| TBP @70 | 996 | 1065 |
| TBP @80 | 1027 | 1089 |
| TBP @90 | 1057 | 1136 |
| TBP @95 | 1079 | 1182 |
| TBP @99.5 | 1132 | 1251 |
| Boiling Range Distribution (5–95) | 463 | 548 |
| Viscosity at 40° C. | 21.00 | 38.62 |
| Viscosity at 100° C. | 4.969 | 7.718 |
| Viscosity Index | 174 | 174 |
| Pour Point, ° C. | −29 | −19 |
| CCS at −25° C., cP* | | 2293 |
| CCS at −35° C., cP | 1058 | 8570 |
| TGA Noack | 37.85 | 22.47 |

*This property represents cold-cranking simulator (CCS) apparent viscosity which is a measure of low temperature cold-cranking in automobile engines determined by ASTM D-5293.

It should be noted that both Fischer-Tropsch blends had volatilities, as measured by TGA Noack, which was suitable for blending engine oils. It should also be noted that the VI of each of the blends was higher than the VI of either FT-2.4 or FT-14 indicating that the blends were realizing a VI premium.

Example 4

The properties of the Fischer-Tropsch derived lubricating base oils as shown in Table 2 above may be compared to the properties of commercially available petroleum derived conventional Group I and Group II light neutral base oils as summarized in Table 3 below.

TABLE 3

| | Chevron Texaco 100R | Generic Gulf Coast Solvent 100 | Gulf Coast H.P. 100 | Exxon Americas Core 100 |
|---|---|---|---|---|
| API Base Oil Category (API 1509 E.1.3) | II | I | II | I |
| D-6352 Simulated TBP (WT %), ° F. | | | | |
| TBP @5 | 659 | | | 647 |
| TBP @10 | 677 | | | 672 |
| TBP @20 | 703 | | | 703 |
| TBP @30 | 723 | | | 725 |
| TBP @50 | 756 | | | 761 |
| TBP @70 | 786 | | | 796 |
| TBP @90 | 825 | | | 839 |
| TBP @95 | 842 | | | 858 |
| TBP @99.5 | 878 | | | 907 |

TABLE 3-continued

| | Chevron Texaco 100R | Generic Gulf Coast Solvent 100 | Gulf Coast H.P. 100 | Exxon Americas Core 100 |
|---|---|---|---|---|
| Boiling Range Distribution (5–95) | 219 | | | 211 |
| Viscosity at 40° C. | 20.0 | 20.4 | 20.7 | 20.2 |
| Viscosity at 100° C. | 4.1 | 4.1 | 4.1 | 4.04 |
| Viscosity Index | 102 | 97 | 97 | 95 |
| Pour Point, ° C. | −14 | −18 | −15 | −19 |
| CCS at −25° C., cP | 1450 | 1430 | 1550 | 1513 |
| CCS at −35° C., cP | >3000 | >3000 | >3000 | >3000 |
| Noack Volatility, wt % | 26 | 29 | 25.5 | 29.3 |

A comparison of Table 2 and 3 illustrate that the Fischer-Tropsch derived lubricating base oils have a similar Noack volatility to conventional Group I and Group II light neutral oils. The kinematic viscosity of Lubricating Base Oil A was comparable to that of the Group I and Group II light neutral oils while that of Lubricating Base Oil B was significantly higher. Lubricating Base Oil A displays a lower pour point than the conventional light neutral oils. The Fischer-Tropsch derived lubricating base oils of the invention also display significantly better VI values.

Example 5

A lubricating base oil blend was prepared which contained 25 weight percent of FT-2.2 and 75 weight percent of FT-14. The kinematic viscosity at 100 degrees C. was found to be 9.007 and the VI was 173. Once again the blend displays a VI premium over the VI's of both FT-2.2 and FT-14.

Example 6

A Fisher-Tropsch distillate fraction designated FT-2.5 was blended with a Fischer-Tropsch derived bright stock designated FT-BS that was prepared by oligomerizing the olefins in a Fischer-Tropsch derived feed. The properties of the two Fischer-Tropsch derived feeds were as follows:

| | FT-2.5 | FT-BS |
|---|---|---|
| Vis. @ 100° C. (cSt) | 2.583 | 30.12 |
| Viscosity Index (VI) | 133 | 132 |
| Pour Point, C. | −30 | −46 |
| Cloud Point, C. | −16 | −10 |
| Noack (wt. %) | 48.94 | |

Two different Fischer-Tropsch derived lubricating base oil blends were prepared and the respective proportions of FT-2.5 and FT-BS in each blend are shown in Table 4 below:

TABLE 4

| | Wt % FT-2.5 | Wt % FT-BS |
|---|---|---|
| Lubricating Base Oil C | 70 | 30 |
| Lubricating Base Oil D | 30 | 70 |

The properties for each of the lubricating base oil blends are summarized in Table 5 below:

TABLE 5

| | Lubricating Base Oil C | Lubricating Base Oil D |
|---|---|---|
| D-2887 Simulated TBP (WT %), ° F. | | |
| TBP @0.5 (Initial Boiling Point) | 599 | 604 |
| TBP @5 | 617 | 634 |
| TBP @10 | 630 | 664 |
| TBP @20 | 656 | 728 |
| TBP @30 | 684 | 809 |
| TBP @40 | 711 | 1048 |
| TBP @50 | 739 | 1114 |
| TBP @60 | 773 | 1165 |
| TBP @70 | 809 | 1210 |
| TBP @80 | 1111 | 1261 |
| TBP @90 | 1226 | 1312 |
| TBP @95 | 1288 | 1335 |
| TBP @99.5 | 1349 | 1373 |
| Boiling Range Distribution (5–95) | 671 | 701 |
| Viscosity at 40° C. | 20.70 | 84.14 |
| Viscosity at 100° C. | 4.799 | 12.58 |
| Viscosity Index | 162 | 147 |
| Pour Point, ° C. | −23 | −33 |
| Cloud Point, ° C. | −16 | −23 |
| CCS at −20° C., cP* | | 4,017 |
| CCS at −25° C., cP* | | 6,665 |
| CCS at −30° C., cP | 1,186 | 11,911 |
| TGA Noack | 34.55 | 14.52 |

*This property represents cold-cranking simulator (CCS) apparent viscosity which is a measure of low temperature cold-cranking in automobile engines determined by ASTM D-5293.

It should be noted that both Fischer-Tropsch blends had excellent VI, low pour points, and low cloud points. Note particularly the VI of the blends which demonstrate a VI premium when compared to the VI's for FT-2.5 and FT-BS. Also note the significant improvement in cloud point as compared with FT-BS. Note that the cloud point for lubricating base oil D displays a cloud point premium, i.e., the cloud point is significantly lower than that for either FT-2.5 or FT-BS. Base oils with a premium cloud point have utility in products which require cold filtration, such as, for example, refrigeration oils. Base oil C, although too high in volatility to be used in engine oils alone, can be further blended as a minority component for engine oils, or used as a majority component in many other lubricant applications, such as, for example, transmission fluids, industrial oils, diluent oils, spray oils, process oils, hydraulic oils, and the like. Base oil D can be used to make 15W 40 engine oil with no added viscosity modifier.

What is claimed is:

1. A process for producing a Fischer-Tropsch derived lubricating base oil blend which comprises blending a Fischer-Tropsch distillate fraction with a Fischer-Tropsch derived bottoms fraction in the proper proportion to produce a Fischer-Tropsch derived lubricating base oil characterized as having a kinematic viscosity of between about 3 and about 10 cSt at 100 degrees C. and a TGA Noack volatility of less than about 45 weight percent wherein said distillate fraction is characterized by a kinematic viscosity of about 2 cSt or greater but less than 3 cSt at 100 degrees C.

2. The process of claim 1 wherein the distillate fraction has a viscosity between about 2.1 and 2.8 cSt at 100 degrees C.

3. The process of claim 2 wherein the distillate fraction has a viscosity between about 2.2 and 2.7 cSt at 100 degrees C.

4. The process of claim 1 wherein the Fischer-Tropsch derived bottoms fraction has a kinematic viscosity between about 9 cSt and about 20 cSt at 100 degrees C.

5. The process of claim 4 wherein the bottoms fraction has a viscosity of between about 10 and about 16 cSt at 100 degrees C.

6. The process of claim 1 wherein the Fischer-Tropsch derived bottoms fraction is bright stock.

7. The process of claim 6 wherein the bright stock is produced by oligomerizing the olefins present in an olefin-containing Fischer-Tropsch derived condensate.

8. The process of claim 7 including the preliminary step of enriching the olefins in the Fischer-Tropsch condensate by the dehydration of the alcohols present in the condensate.

9. The process of claim 7 including the preliminary step of enriching the olefins in the Fischer-Tropsch condensate by the thermal cracking of the hydrocarbons present in the condensate.

10. The process of claim 1 wherein the lubricating base oil blend has a Noack volatility of less than 30 weight percent.

11. The process of claim 1 including the additional step of blending the Fischer-Tropsch lubricating base oil blend with at least one additive to produce a finished lubricant.

12. A process for producing a Fischer-Tropsch derived lubricating base oil blends which comprises the steps of:

a) separating a Fisher-Tropsch derived condensate recovered from a Fischer-Tropsch synthesis zone into at least a first olefin-containing distillate fraction and a second Fischer-Tropsch distillate fraction, said second light distillate fraction having a viscosity of about 2 cSt or greater but less than 3 cSt at 100 degrees C.;

b) oligomerizing the olefins in the first olefin-containing distillate fraction to produce a Fischer-Tropsch derived bright stock;

c) blending the second light Fischer-Tropsch distillate fraction with the Fischer-Tropsch derived bright stock in the proper proportion to produce a Fischer-Tropsch derived lubricating base oil characterized as having a viscosity of between about 3 and about 10 cSt at 100 degrees C. and a TGA Noack volatility of less than about 45 weight percent.

13. The Fischer-Tropsch derived lubricating base oil blend of claim 12 wherein the first olefin-containing distillate fraction as initially separated from the condensate also contains alcohols and at least some of the olefins present in said first olefin-containing distillate fraction are produced by the dehydration of said alcohols.

14. The Fischer-Tropsch derived lubricating base oil blend of claim 12 wherein at least some of the olefins present in the first olefin-containing distillate fraction are produced by cracking the hydrocarbons present in said first olefin-containing distillate fraction to produce an olefin enriched first distillate fraction.

15. The process of claim 14 wherein at least some of the hydrocarbons in the first olefin-containing distillate fraction are cracked in a thermal cracking operation to produce the olefin enriched first distillate fraction.

16. The process of claim 12 including the intermediate step of isomerizing the bright stock prior blending it with the second distillate fraction.

17. A Fischer-Tropsch derived lubricating base oil blend having a viscosity of between about 3 and about 10 cSt at 100 degrees C. and a TGA Noack volatility of less than about 45 weight percent said Fischer-Tropsch derived lubricating base oil blend comprising a Fischer-Tropsch distillate fraction and a Fischer-Tropsch derived bottoms fraction wherein:

(a) said distillate fraction is characterized by a viscosity of about 2 cSt or greater but less than 3 cSt at 100 degrees C. and (b) said Fischer-Tropsch derived bottoms fraction is characterized by a viscosity of not less than about 7 cSt at 100 degrees C.

18. The Fischer-Tropsch derived lubricating base oil blend of claim 17 wherein the distillate fraction has a viscosity between about 2.1 and 2.8 cSt at 100 degrees C.

19. The Fischer-Tropsch derived lubricating base oil blend of claim 18 wherein the distillate fraction has a viscosity between about 2.2 and 2.7 cSt at 100 degrees C.

20. The Fischer-Tropsch derived lubricating base oil of claim 17 having a boiling range distribution of at least 450 degrees F. between the 5 percent and 95 percent points by analytical method D-6352 or its equivalent.

21. The Fischer-Tropsch lubricating base oil of claim 17 wherein the TGA Noack volatility is 12 weight percent or greater.

22. The Fischer-Tropsch lubricating base oil of claim 21 wherein the TGA Noack volatility is greater than about 20 weight percent.

23. The Fischer-Tropsch lubricating base oil blend of claim 17 wherein the TGA volatility is less than about 30 weight percent.

24. The Fischer-Tropsch lubricating base oil of claim 17 wherein the VI is between about 130 and about 185.

25. The Fischer-Tropsch lubricating base oil of claim 17 wherein the total sulfur content is less than about 5 ppm.

26. The Fischer-Tropsch lubricating base oil of claim 17 wherein the Fischer-Tropsch derived bottoms fraction comprises bright stock.

27. The Fischer-Tropsch derived lubricating base oil of claim 26 wherein the cloud point of the blend is lower than the cloud point of either the distillate fraction or the bright stock.

28. A Fischer-Tropsch derived lubricating base oil blend characterized by a viscosity of between about 3 and about 10 cSt at 100 degrees C.; a TGA Noack volatility of less than 45 weight percent; an initial boiling point within the range of between about 550 degrees F. and about 625 degrees F.; an end boiling point between about 1000 degrees F. and about 1400 degrees F.; and wherein less than 30 weight percent of the blend boils within the region defined by the 50 percent boiling points, plus or minus 25 degrees F.

29. The Fischer-Tropsch derived lubricating base oil blend of claim 28 having a boiling range distribution of at least 450 degrees F. between the 5 percent and 95 percent points as measured by analytical method D-6352 or its equivalent.

30. The Fischer-Tropsch lubricating base oil blends of claim 28 wherein the TGA Noack volatility is 12 weight percent or greater.

31. The Fischer-Tropsch lubricating base oil blend of claim 30 wherein the TGA volatility is greater than about 20 weight percent.

32. The Fischer-Tropsch lubricating base oil blend of claim 28 wherein the TGA volatility is less than about 30 weight percent.

33. The Fischer-Tropsch lubricating base oil blend of claim 28 wherein the VI is between about 130 and about 185.

34. The Fischer-Tropsch lubricating base oil blend of claim 28 wherein the total sulfur content is less than about 5 ppm.

35. A finished lubricant comprising a Fischer-Tropsch derived lubricating base oil blend and at least one additive wherein the Fischer-Tropsch derived lubricating base oil blend is characterized by a viscosity of between about 3 and about 10 cSt at 100 degrees C. and comprises a Fischer-Tropsch distillate fraction and a Fischer-Tropsch derived bottoms fraction wherein:

(a) said distillate fraction is characterized by a viscosity of about 2 cSt or greater but less than 3 cSt at 100 degrees C. and (b) said Fischer-Tropsch derived bottoms fraction is characterized by a viscosity of not less than about 9 cSt at 100 degrees C.

36. The finished lubricant of claim 35 wherein the lubricating base oil blend has a Noack volatility of less than about 30 weight percent.

37. The finished lubricant of claim 36 which is suitable for use as an engine oil crankcase lubricant.

* * * * *